US010567097B2

(12) United States Patent
Gautama et al.

(10) Patent No.: US 10,567,097 B2
(45) Date of Patent: Feb. 18, 2020

(54) AUDIO PROCESSING CIRCUIT, AUDIO UNIT AND METHOD FOR AUDIO SIGNAL BLENDING

(71) Applicant: NXP B.V.

(72) Inventors: Temujin Gautama, Boutersem (BE); Joris Luyten, Begijnendijk (BE)

(73) Assignee: NXP B.V., Eindhoven (NL)

( * ) Notice: Subject to any disclaimer, the term of this patent is extended or adjusted under 35 U.S.C. 154(b) by 188 days.

(21) Appl. No.: 15/841,778

(22) Filed: Dec. 14, 2017

(65) Prior Publication Data

US 2018/0175954 A1 Jun. 21, 2018

(30) Foreign Application Priority Data

Dec. 16, 2016 (EP) ..... 16204742

(51) Int. Cl.

| | |
|---|---|
| ***H04B 1/00*** | (2006.01) |
| ***H04H 40/18*** | (2008.01) |
| ***H04H 20/28*** | (2008.01) |
| ***H04H 60/04*** | (2008.01) |

(52) U.S. Cl.

CPC ..... *H04H 40/18* (2013.01); *H04H 20/28* (2013.01); *H04H 60/04* (2013.01)

(58) Field of Classification Search

CPC ..... H04B 1/00

See application file for complete search history.

(56) References Cited

U.S. PATENT DOCUMENTS

| | | | | |
|---|---|---|---|---|
| 4,607,381 | A * | 8/1986 | Shimizu | H04B 1/1684 381/10 |
| 6,490,551 | B2 | 12/2002 | Wiese et al. | |
| 6,590,944 | B1 * | 7/2003 | Kroeger | H04H 20/30 375/340 |
| 7,546,088 | B2 * | 6/2009 | Kroeger | H04H 20/30 375/322 |
| 9,252,899 | B2 * | 2/2016 | Pahuja | H04H 40/36 |
| 9,832,007 | B2 * | 11/2017 | Kroeger | H04H 20/30 |
| 9,837,061 | B2 | 12/2017 | Gautama | |

(Continued)

FOREIGN PATENT DOCUMENTS

EP 1 233 566 A1 8/2002

OTHER PUBLICATIONS

Liu et al. "High Frequency Reconstruction by Linear Extrapolation", Audio Engineering Society Convention Paper 5968, presented at 115th Convention New York, NY, 8 pgs., Oct. 10-13, 2003.

(Continued)

*Primary Examiner* — Olisa Anwah

(74) *Attorney, Agent, or Firm* — Rajeev Madnawat

(57) ABSTRACT

An audio processing circuit is described. The audio processing circuit includes at least one input configured to receive a primary audio signal and a feature generation signal. A feature model estimation circuit is configured to model and output a feature model signal of the primary audio signal. A feature generation circuit is coupled to the feature model estimation circuit and is to receive the feature model signal and the feature generation signal and, in response to the feature model signal, modify the feature generation signal; and output a modified representation of the feature generation signal that is more similar to the primary audio signal.

14 Claims, 5 Drawing Sheets

(56) References Cited

U.S. PATENT DOCUMENTS

| | | | | |
|---|---|---|---|---|
| 2006/0019601 | A1* | 1/2006 | Kroeger | H04H 20/30 455/3.06 |
| 2006/0287744 | A1* | 12/2006 | Kim | G11B 20/10527 700/94 |
| 2007/0291876 | A1* | 12/2007 | Shridhar | H04H 40/18 375/316 |
| 2013/0003801 | A1* | 1/2013 | Elenes | H04H 40/18 375/224 |
| 2013/0343547 | A1* | 12/2013 | Pahuja | H04H 40/36 381/2 |
| 2014/0270252 | A1* | 9/2014 | Pahuja | G10L 21/0208 381/94.5 |
| 2015/0248890 | A1 | 9/2015 | Whitecar et al. | |
| 2016/0042742 | A1* | 2/2016 | Kjoerling | G10L 19/02 704/205 |
| 2017/0179899 | A1* | 6/2017 | Olochwoszcz | G10L 19/167 |

OTHER PUBLICATIONS

Lauber, P. "Error Concealment for Compressed Digital Audio", Audio Engineering Society Convention Paper 5460, presented at 111th Convention New York, NY, 11 pgs., Sep. 21-24, 2001.

* cited by examiner

AUDIO PROCESSING CIRCUIT, AUDIO UNIT AND METHOD FOR AUDIO SIGNAL BLENDING

CROSS-REFERENCE TO RELATED APPLICATIONS

This application claims the priority under 35 U.S.C. § 119 of European Patent application no. 16204742.7, filed on Dec. 16, 2016, the contents of which are incorporated by reference herein.

FIELD OF THE INVENTION

The field of the invention relates to audio spectrum blending, and an audio unit, an audio processing circuit and a method for blending. The invention is applicable to, but not limited to, audio sound systems with processing and amplification therein and a method for blending using a characteristic of an audio signal.

BACKGROUND OF THE INVENTION

In digital radio broadcasts, signals are encoded in the digital domain, as opposed to traditional analog broadcasts using amplitude modulated (AM) or frequency modulated (FM) techniques. The received and decoded digital audio signals have a number of advantages over their analog counterparts, such as a better sound quality, and a better robustness to radio interferences, such as multi-path interference, co-channel noise, etc. Several digital radio broadcast systems that have been deployed and deployed, such as the Eureka 147 digital audio broadcasting (DAB) system and the in-band, on-channel (IBOC) DAB system.

Many radio stations that transmit digital radio also transmit the same radio programme in an analog manner, for example using traditional amplitude modulated (AM) or frequency modulated (FM) transmissions. When two broadcasts for the same radio programme are available (e.g., either two digital broadcasts, or one digital and one analog broadcast, of the same programme), there is the possibility that the radio receiver may switch or cross-fade from one broadcast to the other, particularly when the reception of one is worse than that of the other. Examples of such switching strategies, often referred to as 'blending', are described in U.S. Pat. No. 6,590,944 and US publ. No. 2007/0291876.

When a blending operation from one broadcast technique to another broadcast technique is performed, it is known that artefacts may appear during a cross-fade, if the signals are not perfectly aligned. For example, if there is a small delay between the signals, they will exhibit opposite phases at particular frequencies, and these frequencies will be cancelled out at some point during the cross-fade. This happens even if the delay is as small as two samples.

Furthermore, it is difficult to calculate delays between the signal samples accurately in such real-time systems, in order to determine and correct artefacts due to slightly mis-aligned broadcast signals, particularly if computational resources are restricted. In addition, computing of accurate sampling delay is especially difficult if the signals have different characteristics, e.g., because different pre-processing has been applied. During the cross-fade, there can also be signal cancellation due to phase inversion (i.e., the signals having opposite phase). Next to this, one of the signals may have undergone processing with non-linear phase (e.g., filtering with an infinite impulse response filter), which makes the delay between the signals frequency dependent, and makes it practically impossible to adapt the signals to be perfectly aligned.

When such blending operations occur, and when the FM signal is of sufficiently high quality but has switched to mono (say, because of its weak signal handling), there can be artefacts in the stereo image, especially when there are frequent transitions from the digital to the analog broadcast and back again. In addition to switching to mono, the weak signal handling may apply a high-cut filter to the FM signal, which can cause additional artefacts when switching between analog and digital broadcast.

When the reception quality of digital audio signal transmissions degrades, the received (encoded) signals may contain bit errors. If the bit errors are still present after all error detection and error correction methods have been applied, the corresponding audio frame may not be decodable anymore and is 'corrupted' (either completely or in part). One way of dealing with these errors is to mute the audio output for a certain period of time (e.g., during one or more frames). The left and right channel of a stereo transmission are encoded separately (or at least, for the most part), and a stereo signal is expected to remain a stereo one as the reception quality degrades.

When the reception quality of an FM tuner/signal deteriorates, the sum and difference signals are influenced differently. When the received FM signal contains white noise, the corresponding demodulated noise component linearly increases with frequency. Since the sum signal is present in the low frequency area (up to 15 kHz), the signal-to-noise ratio (SNR) is considerably better in the sum signal than in the difference signal (which is present in the band from 24 kHz to 53 kHz). This means that in noisy conditions, the sum signal contains less noise than the stereo signal (since the left and right signals are derived from the sum and the difference signal). Hence, when the reception quality of an FM transmission degrades, the audio signal is often changed from stereo to mono in order to preserve the audio quality of the sum signal. This operation exploits the fact that FM is transmitted as a sum and a difference signal, rather than as a left and a right channel.

From the above, it follows that two broadcasts, e.g., a DAB and an FM one, can have different stereo information, due to processing that has been performed as a result of bad reception quality. It can also be the case that the broadcasts have different stereo information under perfect reception conditions (e.g., AM has a lower audio bandwidth and is mono, so a hybrid DAB/AM combination will always have different characteristics). Therefore, when a blending operation from one broadcast to the other is performed, there can be stereo artefacts as a consequence, for example the stereo image will change during the blending operation, especially when there are frequent transitions from one broadcast to the other and back.

If the reception quality of the FM signal degrades further, a high-cut filter may be applied to the audio signal by the weak signal handling. The cut-off frequency of this filter is decreased with decreasing signal quality. The difference in high-frequency content between a digital and analog broadcast may also cause artefacts in blending, in particular with frequent transitions between the broadcasts.

These artefacts caused by weak signal handling (stereo and/or higher frequency information discarded on FM) can be reduced by using a long cross-fade time in the blending operation. This leads to a smoother, more gradual transition between the signals with different characteristics. In US20150371620 a mechanism is proposed that reduces the stereo artefacts by using different cross-fade times on sum and difference signals. Transitions in the sum signal can be done quickly, while the difference signals are cross-faded more slowly. This method with long cross-fade times requires that both broadcasts remain available for a sufficiently long time (preferably at least two seconds) after the start of the blending operation, in order to obtain a smooth cross-fading of the relevant signal characteristics. For DAB broadcasts this is not always possible: DAB signals can transition from good quality to being non-decodable from one frame to the next. If the DAB quality drops so abruptly, the slow cross-fade on the difference signal cannot be used, since the DAB signal is no longer available.

Thus, an improved audio processing circuit, audio unit and method of spectrum blending is needed.

SUMMARY OF THE INVENTION

The present invention provides an audio processing circuit, audio unit and a method of spectrum blending therefor, as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION

Figure 1:
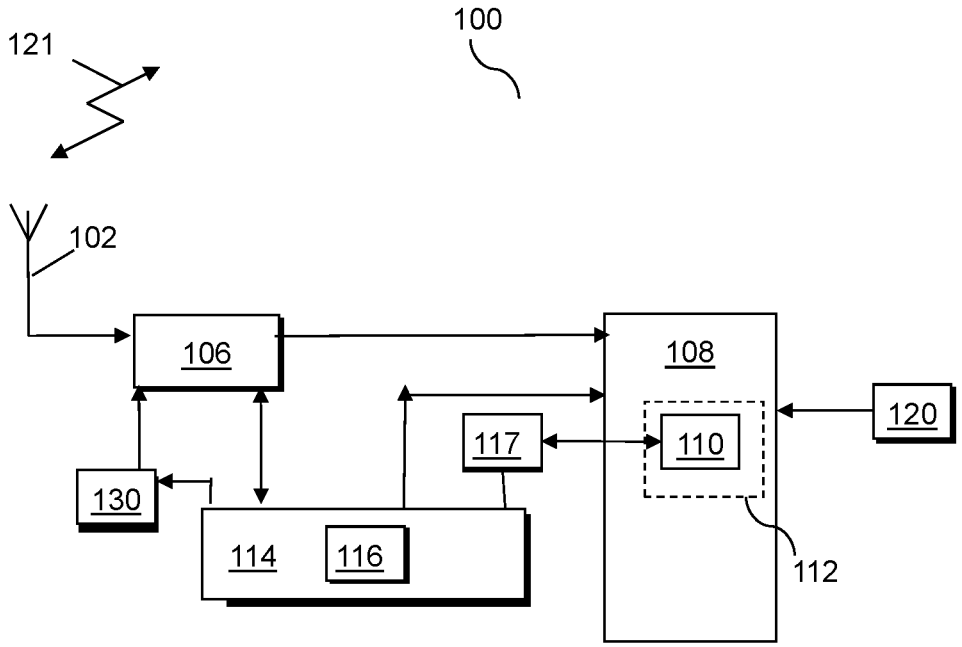
FIG. 1 illustrates a simplified example block diagram of a wireless unit, adapted according to example embodiments of the invention.

Examples of the present invention provide a mechanism to perform blending by adapting one of the audio signals with a characteristic from one of the other audio signals. Examples of the invention find applicability in car radios, sound systems, audio units, audio processing units and circuits, audio amplifiers, etc. Hereafter, the term 'audio unit' will encompass all such audio devices and audio systems and audio circuits.

Although examples of the invention are described with regard to solving digital audio broadcast reception by improving the blending between a corresponding digital audio broadcast (DAB) and an analog frequency modulated (FM) signal, it is envisaged that the concepts described herein are equally applicable to blending between DAB and amplitude modulated (AM) signals and FM-AM signals. Also, it is envisaged that the concepts described herein are equally applicable to different standards for the digital stream such as digital radio mondiale (DRM), Internet radio, etc.

Examples of the invention, describe an audio processing circuit that includes at least one input configured to receive a primary audio signal and a feature generation signal. A feature model estimation circuit is configured to model and output a feature model signal of the primary audio signal. A feature generation circuit is coupled to the feature model estimation circuit and is configured to receive the feature model signal and the feature generation signal and, in response to the feature model signal, modify the feature generation signal; and output a modified representation of the feature generation signal that is more similar to the primary audio signal.

In this manner, a more gradual (slower) transition in a blending operation can occur with an additional introduction of a modelled characteristic affecting a signal to be blended.

In some examples, the feature generation signal may be a secondary audio signal. In some examples, audio processing circuit may further include a feature mixing circuit coupled to an output of the feature generation circuit and configured to receive a feature mixing factor and both of the feature generation signal and the modified representation of the feature generation signal. In this manner, an influence exerted on the feature generation signal may be controlled by the feature mixing factor.

In some examples, audio processing circuit may further include a blending mixing circuit configured to receive a blending mixing factor and both of the primary audio signal and an output of the feature mixing circuit. In some examples, the blending mixing circuit may be configured to output a blended audio signal in response to the blending mixing factor that includes one of:

(i) the primary audio signal, (ii) the output of the feature mixing circuit, (iii) a blended mixture of: (i) and (ii).

In this manner, an influence exerted in a blending operation may be controlled by the blending mixing factor. In this manner, a range of blended signals can be obtained, with or without a use of a synthesised version (based on the modelled characteristic/feature) of a primary audio signal.

In some examples, the blending mixing circuit may be configured to provide the feature generation signal to the feature generation circuit and configured to receive a blending mixing factor and both of the primary audio signal and the secondary audio signal. For example, an output of the blending mixing circuit may include one of:

(i) the primary audio signal, (ii) the secondary audio signal, (iii) a blended mixture of: (i) and (ii).

In some examples, the feature mixing circuit may be configured to receive a feature mixing factor and both of an output from the blending mixing circuit and a modified representation of the output from the blending mixing circuit in response to the feature model signal.

In some examples, at least one of the blending mixing factor (gB) and the feature mixing factor (gF) may be configured to vary over time. In this manner, a better control of the cross-fade transition can be achieved.

In some examples, for a modelled characteristic of, say, the stereo and/or spectral content during a blending operation, it may be possible to reduce possible artefacts in the stereo image and/or the higher frequency bands.

In some examples, the primary audio signal may be received from a first broadcast audio signal and the secondary audio signal may be received from a second different broadcast audio signal, wherein the first broadcast audio signal and second broadcast audio signal are available simultaneously. In this manner, the concepts herein described may be applied to any blending between known broadcast techniques, for example the concepts may be applied in the context of simulcasts, where the same audio content is received from multiple broadcasts (e.g., AM, FM and/or DAB) and the two audio signals are available simultaneously to the system.

Because the illustrated embodiments of the present invention may, for the most part, be implemented using electronic components and circuits known to those skilled in the art, details will not be explained in any greater extent than that considered necessary as illustrated below, for the understanding and appreciation of the underlying concepts of the present invention and in order not to obfuscate or distract from the teachings of the present invention.

Referring first to FIG. 1, an example of an audio unit 100, such as a radio receiver, adapted in accordance with some examples, is shown. Purely for explanatory purposes, the audio unit 100 is described in terms of a radio receiver capable of receiving wireless signals carrying digital audio broadcast or analog frequency modulated or amplitude modulated signals. The radio receiver contains an antenna 102 for receiving transmissions 121 from a broadcast station. One or more receiver chains, as known in the art, include receiver front-end circuitry 106, effectively providing reception, frequency conversion, filtering and intermediate or base-band amplification. In a radio receiver, receiver front-end circuitry 106 is operably coupled to a frequency generation circuit 130 that may include a voltage controlled oscillator (VCO) circuit and PLL arranged to provide local oscillator signals to down-convert modulated signals to a final intermediate or baseband frequency or digital signal.

In some examples, such circuits or components may reside in signal processing module 108, dependent upon the specific selected architecture. The receiver front-end circuitry 106 is coupled to a signal processing module 108 (generally realized by a digital signal processor (DSP)). A skilled artisan will appreciate that the level of integration of receiver circuits or components may be, in some instances, implementation-dependent.

A controller 114 maintains overall operational control of the radio receiver, and in some examples may comprise time-based digital functions (not shown) to control the timing of time-dependent signals, within the radio receiver. The controller 114 is also coupled to the receiver front-end circuitry 106 and the signal processing module 108. In some examples, the controller 114 is also coupled to a timer 117 and a memory device 116 that selectively stores operating regimes, such as decoding/encoding functions, and the like.

A single processor may be used to implement a processing of received broadcast signals, as shown in FIG. 1. Clearly, the various components within the radio receiver 100 can be realized in discrete or integrated component form, with an ultimate structure therefore being an application-specific or design selection.

In accordance with some example embodiments, an audio signal processing circuit 110 has been adapted to perform a blending operation that uses a characteristic of one audio signal, e.g. stereo information or high frequency content, to influence the synthesis of another received audio signal carrying the same content. The audio processing circuit includes at least one input configured to receive a primary audio signal and a feature generation signal. A feature model estimation circuit is configured to model and output a feature model signal of the primary audio signal. A feature generation circuit is coupled to the feature model estimation circuit and is to receive the feature model signal and the feature generation signal and, in response to the feature model signal, modify the feature generation signal; and output a modified representation of the feature generation signal that is more similar to the primary audio signal.

This use of a characteristic of one audio signal, e.g. stereo information or high frequency content, to influence the synthesis of another received audio signal carrying the same content, may enable the cross-fade time to be applied slower and/or with fewer artefacts, as controlled by controller 114 and/or timer 117.

A skilled artisan will appreciate that the level of integration of receiver circuits or components may be, in some instances, implementation-dependent. In some examples, the audio signal processing circuit 110 may be implemented as an integrated circuit 112, which may include one or more other signal processing circuits.

Furthermore, the signal processor module in the transmit chain may be implemented as distinct from the signal processor in the receive chain. Alternatively, a single processor 108 may be used to implement a processing of both transmit and receive signals, as shown in FIG. 1, as well as some or all of the BBIC functions. Clearly, the various components within the wireless communication unit 100 can be realised in discrete or integrated component form, with an ultimate structure therefore being an application-specific or design selection.

Figure 2:
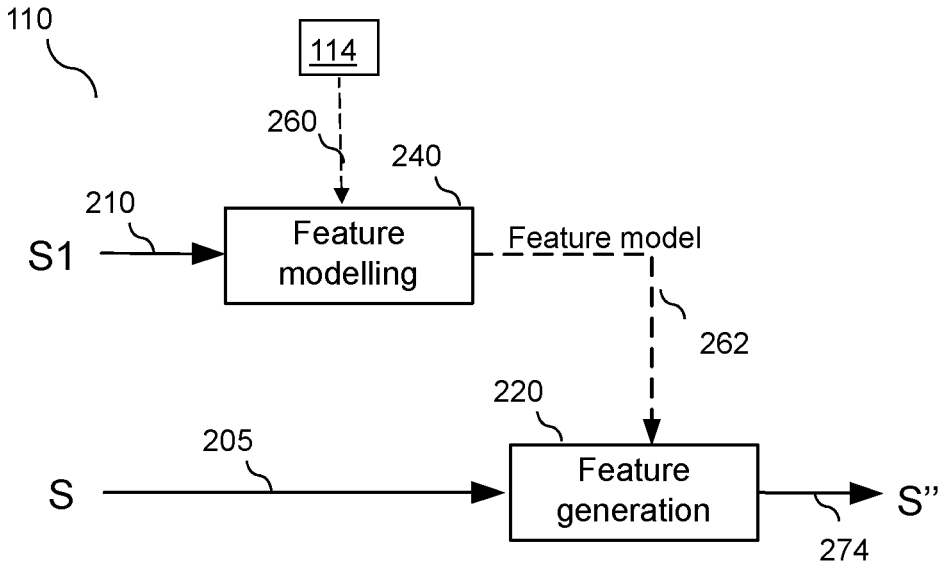
FIG. 2 shows a conceptual diagram of an audio processing circuit having a feature generation circuit, according to an example embodiment of the invention.

Referring now to FIG. 2, a conceptual diagram of the audio processing circuit 110 of FIG. 1 having a feature generation circuit is illustrated, according to example embodiments of the invention. Two input audio signals are represented by a primary audio signal S1 210 and a feature generation signal S 205 respectively. It is assumed that appropriate delays have been applied by a signal processing circuit prior to input to the audio processing circuit 110, so that primary audio signal S1 210 and feature generation signal S 205 are substantially synchronised with any remaining delay between primary audio signal S1 210 and feature generation signal S 205 being limited to a small number of samples.

In this example, primary audio signal S1 210 is passed through a feature model estimation circuit 240. In this example, feature model estimation circuit 240 does not change primary audio signal S1 210, but is configured to model a particular characteristic or feature of the input primary audio signal, e.g. the stereo information or the high frequency content, and thus output a feature model signal 262. The feature model signal 262 is only updated when the primary audio signal S1 210 is not corrupted and is available, when it is updated by controller 114 via update control signal 260.

In this example, the feature generation signal S 205 is input to a feature generation circuit 220. In this example, feature generation circuit 220 receives the feature model signal 262 from the feature model estimation circuit 240. In this example, the feature model signal 262 is used by the feature generation circuit 220 to generate a signal S" 274 from feature generation signal S 205, which is more similar to primary audio signal S1 210 with respect to the modelled characteristic/feature.

Figure 3:
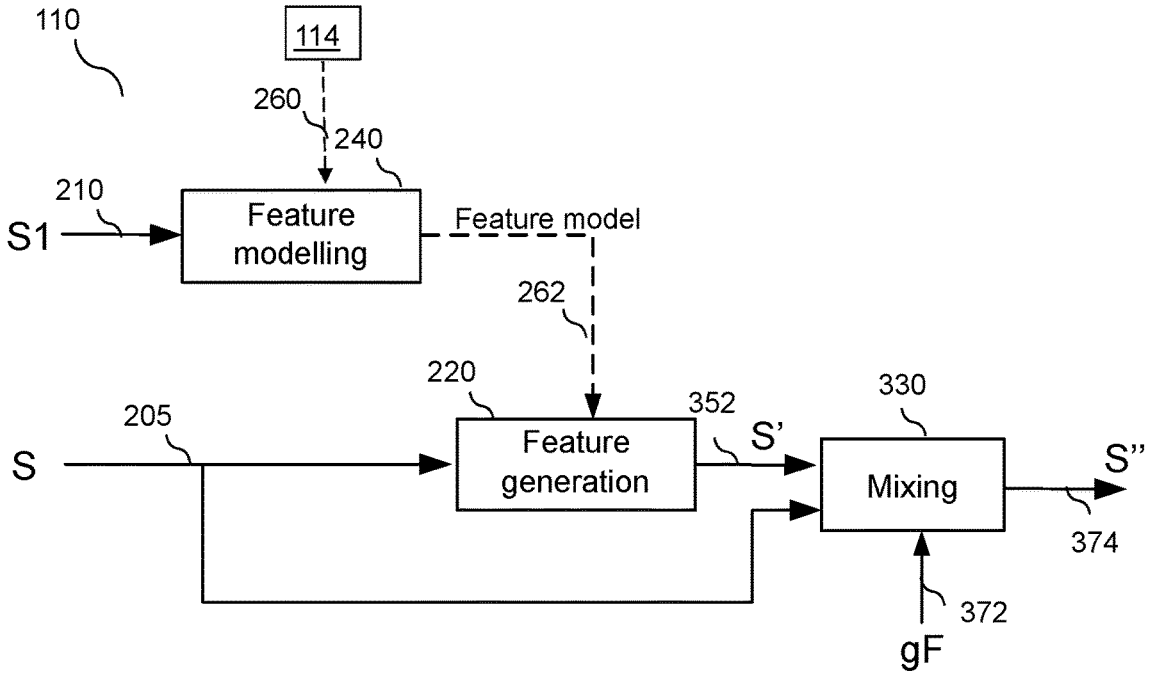
FIG. 3 shows a further, more detailed, conceptual diagram of the audio processing circuit having a feature generation circuit of FIG. 2, according to an example embodiment of the invention.

FIG. 3 shows a further, more detailed, conceptual diagram of the audio processing circuit 110 of FIG. 1 having a feature generation circuit of FIG. 2, according to an example embodiment of the invention. Again, two input audio signals are represented by a primary audio signal S1 210 and a feature generation signal S 205 respectively. It is assumed that appropriate delays have been applied by a signal processing circuit prior to input to the audio processing circuit 110, so that primary audio signal S1 210 and feature generation signal S 205 are substantially synchronised with any remaining delay between primary audio signal S1 210 and feature generation signal S 205 being limited to a small number of samples.

In this example, primary audio signal S1 210 is passed through a feature model estimation circuit 240. In this example, feature model estimation circuit 240 does not change primary audio signal S1 210, but is configured to model a particular characteristic/feature of the input audio signal, e.g. the stereo information or the high frequency content, and thus output a feature model signal 262. The feature model signal 262 is only updated when the primary audio signal S1 210 is not corrupted and is available, when it is updated by controller 114 via update control signal 260.

In this example, the feature generation signal S 205 is input to a feature generation circuit 220. In this example, feature generation circuit 220 receives the feature model signal 262 from the feature model estimation circuit 240. In this example, the feature model signal 262 is used by the feature generation circuit 220 to generate a signal S' 352 from feature generation signal S 205, which is more similar to primary audio signal S1 210 with respect to the modelled characteristic/feature. The output signal S2' 352 from the feature generation circuit 220 is input to feature mixing circuit 330 together with feature generation signal S 205. These two signals, namely output signal S2' 352 and feature generation signal S 205 are mixed with a feature mixing factor (gF) 372, which in this example is in the range [0;1]. In some examples, the mixing factor (gF) 372 may be subject to an external control. Thus, if gF=1, the output signal S' 352 with a synthesised characteristic feature is obtained, whereas if gF=0, the original feature generation signal S 205 is obtained. This results in a signal S" 374 computed from:

$$S''=gF\cdot S'+(1-gF)\cdot S \quad [1]$$

Figure 4:
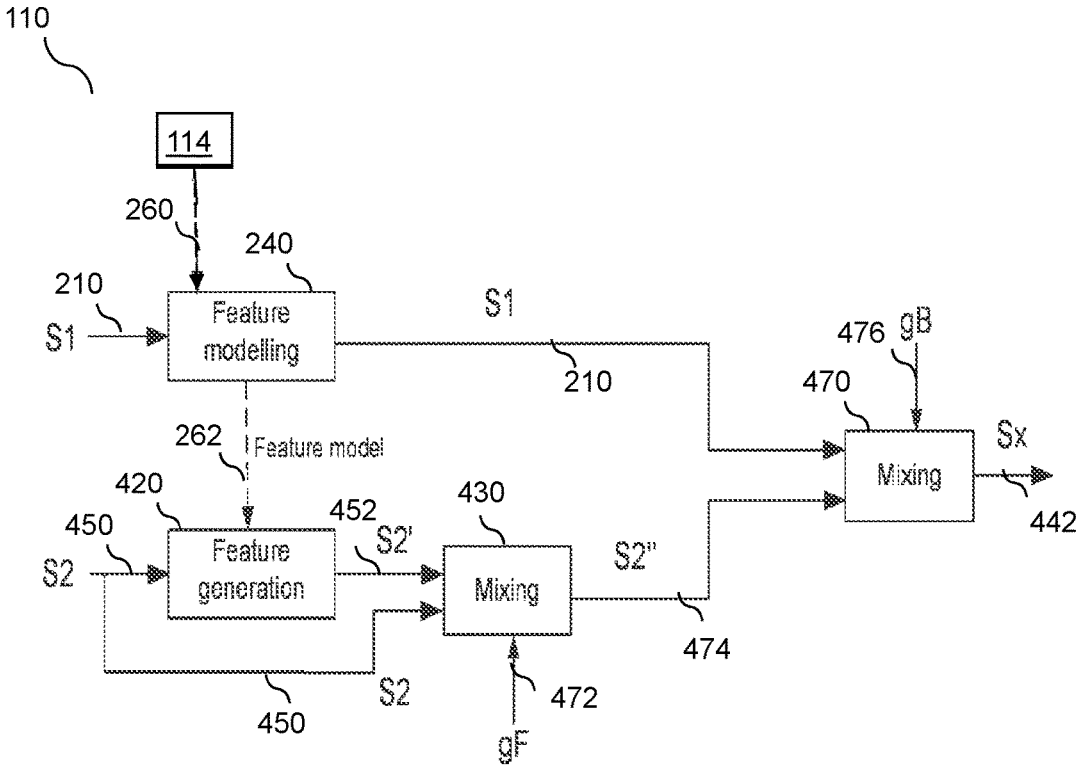
FIG. 4 illustrates a further, more detailed, conceptual diagram of an audio processing circuit, according to a first example embodiment of the invention.

Referring now to FIG. 4, a more detailed block diagram of a first example audio processing circuit, such as the audio processing circuit 110 of FIG. 1, and FIG. 3 is illustrated. In this example, the two audio signals in the input are represented by a primary audio signal S1 210 and a secondary audio signal S2 450, respectively. It is assumed that appropriate delays have been applied by a signal processing circuit prior to input to the audio processing circuit 110, so that primary audio signal S1 210 and secondary audio signal S2 450 are substantially synchronised with any remaining delay between primary audio signal S1 210 and secondary audio signal S2 450 being limited to a small number of samples.

In this example, primary audio signal S1 210 is passed through a feature model estimation circuit 240. In this example, feature model estimation circuit 240 does not change primary audio signal S1 210, but is configured to model a particular characteristic of the input audio signal, e.g. the stereo information or the high frequency content, and thus output a feature model signal 262. The feature model signal 262 is only updated when the primary audio signal S1 210 is not corrupted and is available, when it is updated by controller 114 via update control signal 260. In other examples, the feature model estimation circuit 240 may be configured to model a particular characteristic of the secondary audio signal S2 450 instead of the primary audio signal S1 210.

In this example, secondary audio signal S2 450 is input to a feature generation circuit 420. In this example, feature generation circuit 420 receives the feature model signal 462 from the feature model estimation circuit 440. In this example, the feature model signal 462 is used by the feature generation circuit 420 to generate a signal S2' 452 from secondary audio signal S2 450, which is more similar to primary audio signal S1 210 with respect to the modelled feature.

In one example, primary audio signal S1 210 may be a DAB signal and secondary audio signal S2 450 may be an FM signal. In this manner, and in this example, the model parameters contained in feature model signal 462 are determined based on the DAB signal and applied to the FM signal.

In some examples, therefore, a controller or processor such as controller 114 or audio processing circuit 110 of FIG. 1 may recognise that, say, reception quality of the DAB signal is deteriorating rapidly, and instigates a process to model the feature model parameters based on the DAB signal and apply them to the FM signal.

In this example, the output signal S2' 452 from the feature generation circuit 420 is input to feature mixing circuit 430 with secondary audio signal S2 450. These two signals are mixed with a feature mixing factor (gF) 472, which in this example is in the range [0;1]. In some examples, the mixing factor (gF) 472 may be subject to an external control. Thus, if gF=1, the output signal S2' 452 with a synthesised characteristic feature is obtained, whereas if gF=0, the original secondary audio signal S2 450 is obtained. This results in a signal S2" computed from:

$$S2''=gF\cdot S2'+(1-gF)\cdot S2 \quad [2]$$

The output signal S2" 474 from the feature mixing circuit 430 and the primary audio signal S1 210 are input to a blending mixing circuit 470 where a blending mixing factor gB 476 is applied in the range [0;1]. If gB=1, the primary audio signal S1 210 is obtained, whereas if gB=0, the secondary audio signal (with or without the synthesised characteristic feature, depending on 'gF' 472) is obtained.

The output signal Sx 442 from the blending mixing circuit 470 includes either the primary audio signal S1 210, or the secondary audio signal (with or without the synthesised characteristic feature, depending on 'gF' 472) or a blended version there between.

In operation, the circuit of FIG. 4 may perform a blending operation from a primary audio signal S1 210 to a secondary audio signal (with or without the synthesised characteristic feature, depending on 'gF' 472) as follows. For a blending operation from a secondary audio signal (with or without the synthesised characteristic feature, depending on 'gF' 472) to primary audio signal S1 210 the approach shown in FIG. 4 can be used with primary audio signal S1 210 and secondary audio signal 450 swapped. In this manner, the feature model estimation is performed on the secondary audio signal 450 and the feature generation applied to the primary audio signal 210.

Before a start of a blending operation the mixing factor gB 476 is 1, and the primary audio signal 210 is sent to the output 442. When a blending operation (from primary audio signal 210 to secondary audio signal 450) is initiated by the host application, e.g. controller 114 from FIG. 1, mixing factor gB 476 changes from '1' to '0'. If this change is instantaneous, the blending operation simply switches from primary audio signal S1 210 to secondary audio signal S2 450. In this example, it is assumed that the feature mixing factor gF 472 is fixed to '0', so that S2" 474 is the same as secondary audio signal S2 450. However, if the mixing factor gB 476 value changes smoothly over time, during a blending operation, a traditional cross-fade from the primary audio signal S1 210 to the secondary audio signal S2 450 is obtained. If, additionally, feature mixing factor gF 472 is changed smoothly from '1' to '0' during the blending operation, the characteristics of S2" 474 with respect to the modelled feature (from feature model signal 462) will change gradually from those of S2' (with feature characteristics similar to those of primary audio signal S1 210) to those of secondary audio signal S2 450.

By changing mixing factor gB 476 and feature mixing factor gF 472 differently over time, a fast transition from primary audio signal S1 210 to S2" 474 (changing to secondary audio signal S2 450 whilst preserving modelled feature characteristics) can be obtained, in combination with, or followed by, a slower transition from S2" 474 to secondary audio signal S2 450 (slowly fading out the difference in feature characteristics between primary audio signal S1 210 and secondary audio signal S2 450). The slower fading of the feature characteristics may be used to reduce artefacts due to different signal characteristics during the blending operation. The output cross-faded signal Sx 442 is obtained as:

$$Sx=gB\cdot S1+(1-gB)\cdot S2'' \quad [3]$$

In some examples, the mixing factors transition, e.g., from 1 to 0, over a given time t1, where t1 may be specified by a user-parameter. In some examples, it is envisaged that the various transitions from a primary audio signal S1 210 to a secondary audio signal (with or without the synthesised characteristic feature, depending on 'gF' 472), or the reverse (with or without the synthesised characteristic feature applied to the primary audio signal S1 210, depending on a corresponding 'gF'), may be calibrated and tuneable during a design phase. Such calibrated information may be stored, for example within memory device 116 of FIG. 1.

The application of a feature mixing factor gF 472 allows to go from the signal with synthesised characteristic features, S2' 452, to the original secondary audio signal, S2 450, without involvement of the primary audio signal 210 S1. In this manner, it is possible to make a transition of feature mixing factor gF 472 from '1' to '0' slower than the traditional blending operation (of blending factor gB 476 going from '1' to '0'). As a consequence, it is advantageously possible to fade out the modelled feature slower, for example the stereo information or high-frequency information, thereby leading to a more gradual blending result. This is not possible in a traditional blend, because often the digital primary audio signal S1 210 is not available after the fast blend (as the audio is corrupted).

In some examples, it is envisaged that the feature model estimation circuit 440 may model features of, for example, stereo information (as described below with respect to FIG. 5) or high frequency signal content, etc. In other examples, other features or characteristics of the audio signals may be modelled. In some examples, more than one feature may be modelled and incorporated into the feature model estimation circuit 440 of FIG. 4

Figure 5:
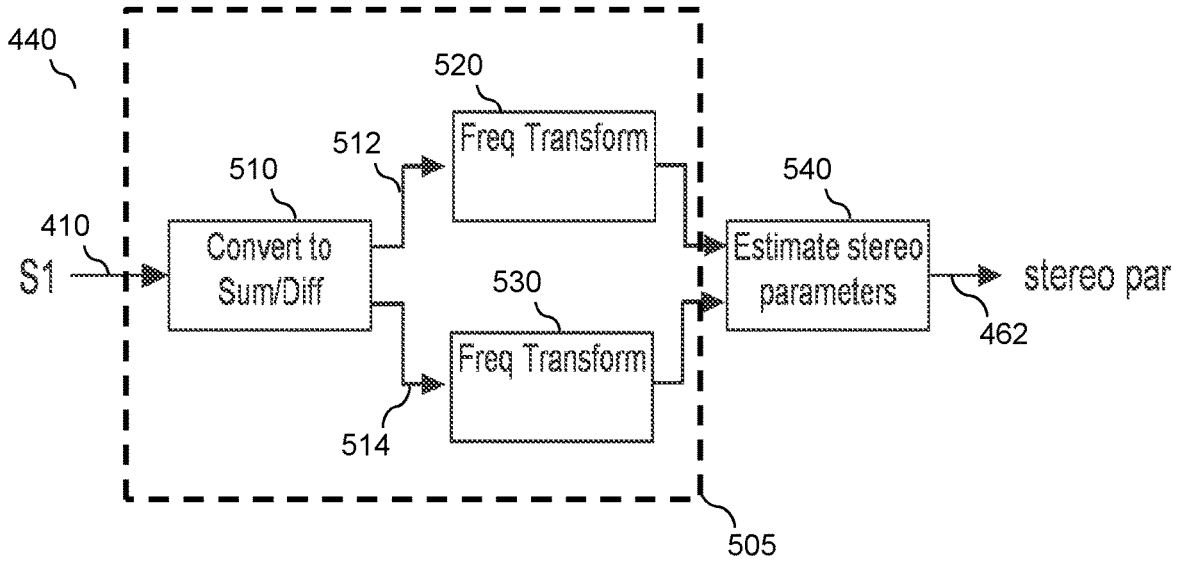
FIG. 5 illustrates an example block diagram of a feature model estimation circuit that estimates the stereo parameters of a primary audio signal S1, according to example embodiments of the invention.

Referring now to FIG. 5, an example block diagram of a feature model estimation circuit 440 that estimates the stereo parameters of the primary audio signal S1 210 of FIG. 4 is illustrated according to example embodiments of the invention. In one example, a mechanism to model the stereo information of a signal and to regenerate this information from a mono down-mix of the signal may be performed. In this example, the primary audio signal S1 410 is input to, say, an analysis module 505. In this example, the analysis module 505 includes a circuit 510 to convert the primary (stereo) signal S1 410 into a sum ('mono') signal 512 (left+right channels) and a difference signal 514 (left−right channels). The respective signals are transformed to the frequency domain using frequency transform circuits 520, 530. The modelled signals are then input to a parametric stereo coding circuit 540 to produce stereo parameter estimates, as one example of a feature model signal 462.

In an alternative (or additional) embodiment, the feature model estimation circuit 440 may use the higher frequency bands of the signal spectrum as the feature, e.g. the 15 kHz-40 kHz signals. In this case the feature modelling aspect may consist of modelling the shape of the spectrum, so that the feature generation can generate the higher frequency bands from the lower frequency bands. The lower frequency band is typically replicated in the higher frequency band, and a number of parameters may be determined in order to characterise the processing that is required on the replicated band to better match the original higher frequency band.

Figure 6:
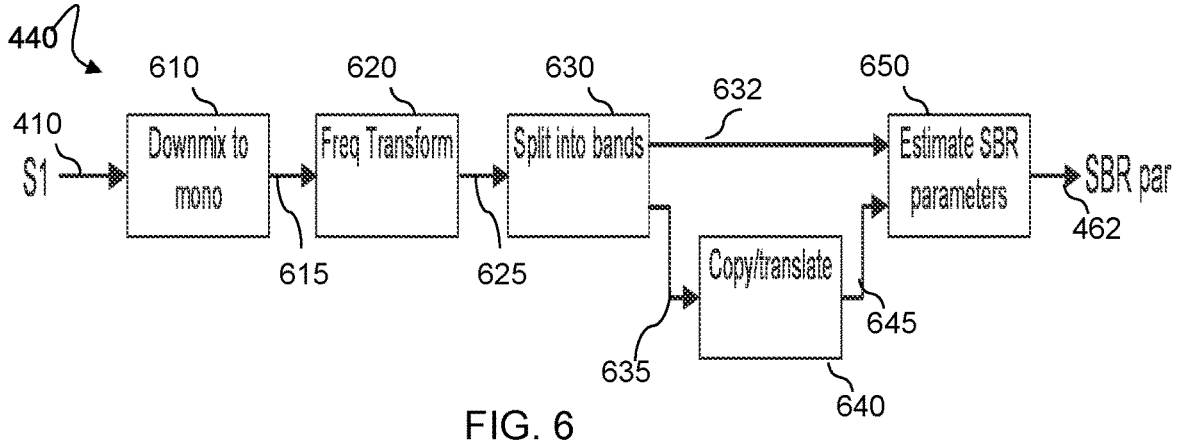
FIG. 6 illustrates an example conceptual diagram of a system to estimate the Spectral Band Replication (SBR) parameters.

Referring now to FIG. 6, one example of spectral content modelling is illustrated to estimate Spectral Band Replication (SBR) parameters. Here, a stereo input primary audio signal S1 410 is down-mixed in mixer 610 to a mono signal 615 (e.g., by computing the average of the left and right channel). The mono signal 615 is transformed to the frequency domain using a frequency transform circuit 620 to generate a frequency domain representation of the mono signal 625 and divided into a low band and a high band in band-splitting circuit 630. In some examples, the band-splitting circuit 630 may be a set of parallel band-pass filters. A low band (lower branch) signal 635 is copied or translated to the high frequency bands 645 in copy/translate circuit 640 and compared to the original high frequency band signal 632. In this example, the comparison is performed in circuit 650 that is used to estimate SBR parameters, as a further example of a feature model signal 462.

Figure 7:
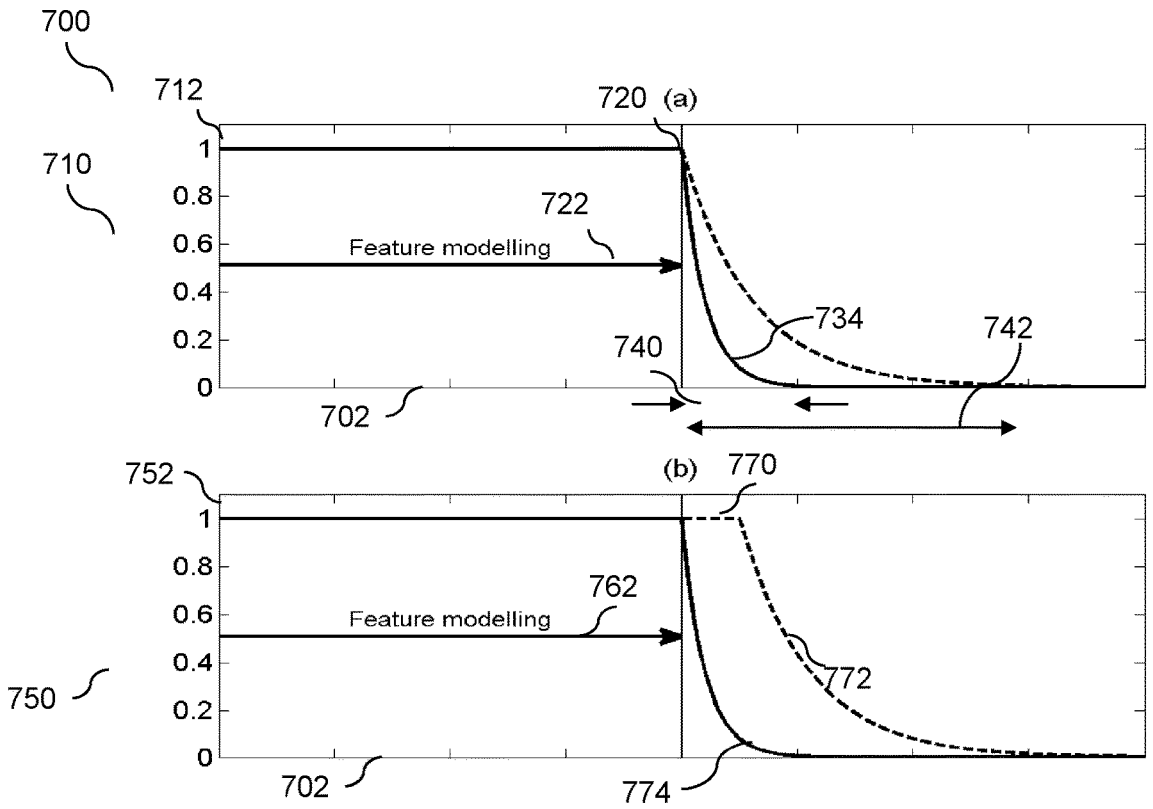
FIG. 7 illustrates a graphical example of a change of the mixing factors (gB as solid and gF as dashed curves) over time, according to example embodiments of the invention.

FIG. 7 illustrates a graphical example 700 of a change of the feature mixing factor (gF 472) and blending mixing factors (gB 476) with blending mixing factor identified as a solid line and feature mixing factor (gF 472) identified as a dashed line. Two graphical examples are illustrated over time 702: (a) with a simultaneous start 720 of feature cross-fade 710; and (b) with a postponed 770 feature cross-fade 750.

The initiation of the blending operation is represented by the thin solid vertical line. Before the blending operation, the blending mixing factor gB 476 is '1', as a consequence of which the output before the blending operation is the primary audio signal 210. During the blending operation, blending mixing factor gB 476 changes rapidly 734 to '0', due to which the output signal Sx 442 changes rapidly from the primary audio signal 210 to signal S2" 474.

The feature mixing factor gF 472 changes more slowly over time 772, due to which the feature characteristics will change slowly from the primary audio signal S1 210 to the secondary audio signal S2 450, and as a result, feature-related artefacts will be reduced.

In part (a) 710, the cross-fading of the feature information starts 720 concurrently with the cross-fading of the primary audio signal S1 210 to secondary audio signal S2 450. In part (b) 750 an example is shown where the feature information cross-fading starts only when the cross-fade from primary audio signal S1 210 to secondary audio signal S2 450 is largely completed 774.

The feature model estimation on the primary audio signal should be stopped 722, 762 before, or at the start of, the blending operation, such that possible signal quality loss of the primary audio signal does not affect the feature model estimation.

Figure 8:
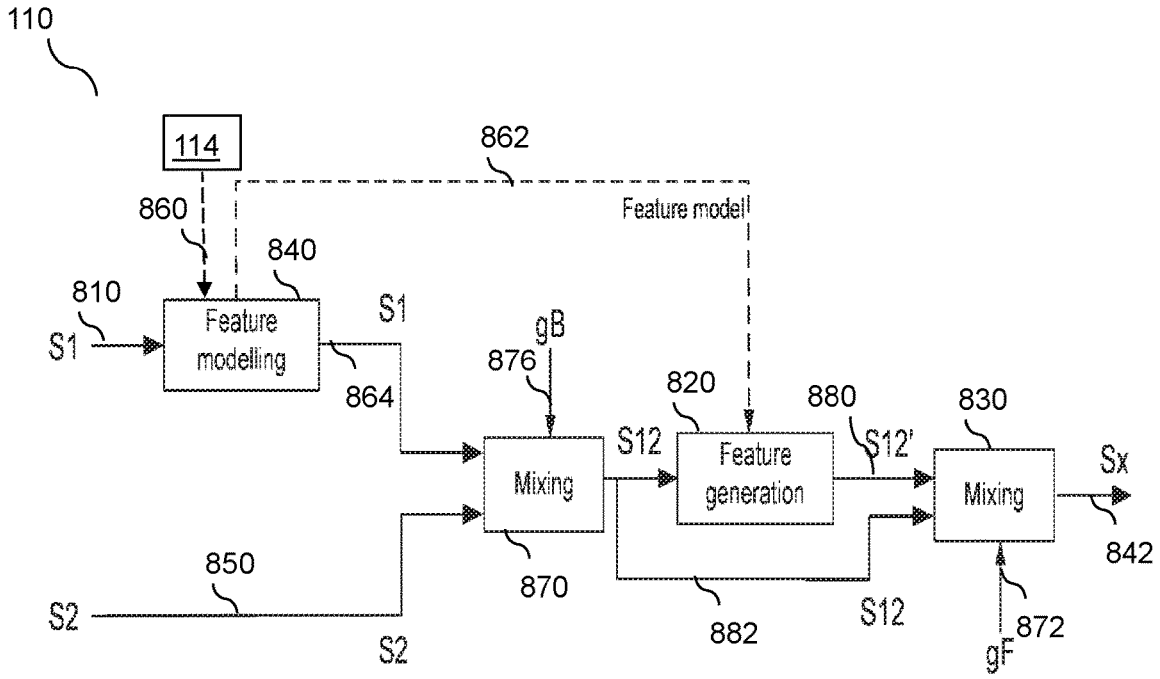
FIG. 8 illustrates a yet further, more detailed, conceptual diagram of an audio processing circuit, according to a second example embodiment of the invention.

FIG. 8 shows an alternative second example embodiment of an audio processing circuit, such as the audio processing circuit 110 of FIG. 1 and FIG. 3. Here, in contrast to the embodiment in FIG. 4, the feature generation is applied later in the audio path, after the mixing of inputs primary audio signal S1 810 and secondary audio signal S2 850. It is assumed that appropriate delays have been applied by a signal processing circuit prior to input to the audio processing circuit 110, so that primary audio signal S1 810 and secondary audio signal S2 850 are substantially synchronised with any remaining delay between primary audio signal S1 810 and secondary audio signal S2 850 being limited to a small number of samples.

Primary audio signal S1 810 is passed through a feature model estimation circuit 840. In this example, feature model estimation circuit 840 does not change primary audio signal S1 810, but is configured to model a particular characteristic of the input audio signal, e.g. the stereo information or the high frequency content, and thus output a feature model signal 862. The feature model signal 862 is only updated when the primary audio signal S1 810 is not corrupted and is available, when it is updated by controller 114 via update control signal 860. After feature model estimation circuit 840, primary audio signal S1 810 together with secondary audio signal S2 850 are input into a blending mixing circuit 870, where a blending mixing factor gB 876 is applied in the range [0;1]. If gB=1, the primary audio signal S1 810 is obtained, whereas if gB=0, the secondary audio signal S2 850 is obtained. This results in a mixer output signal S12 882 computed as:

$$S12=gB\cdot S1+(1-gB)\cdot S2 \quad [3]$$

mixer output signal S12 882 that is fed into a feature generation circuit 820 that generates a signal S12' 880, which is similar to primary audio signal S1 810 with respect to the modelled feature(s) (since the feature generation uses the feature model estimated from primary audio signal S1 810). The mixer output signal S12 882 and signal S12' 880 output from feature generation circuit 820 are input to a feature mixing circuit 830. These two signals are mixed with a feature mixing factor (gF) 872, which in this example is in the range [0;1]. Thus, if gF=1, the output signal S12' 880 is the 'blended' signal (i.e. a mix of primary audio signal S1 810 and secondary audio signal S2 850) with synthesised characteristic features is obtained, whereas if gF=0, the the blended signal 882 without feature processing is obtained. This results in an output signal Sx computed from:

$$Sx=gF\cdot S12'+(1-gF)\cdot S12 \quad [4]$$

In the remainder, a blending operation from the primary audio signal S1 810 to the secondary audio signal S2 850, is assumed. Before the start of the blending operation the mixing factor gB is '1', and the primary audio signal is sent to the output (for now it is assumed that gF is fixed to '0', so that Sx equals S12). When a blending operation (from the primary audio signal S1 810 to the secondary audio signal S2 850) is initiated by the host application, gB changes from a '1' to '0'. If this change is instantaneous, the blending operation simply switches from primary audio signal to secondary audio signal. If the value changes smoothly over time during the blending operation, a traditional cross-fade from the primary to the secondary audio signal is obtained. If also gF is changed smoothly from '1' to '0' during the blending operation, the characteristics of Sx 842 with respect to the modelled feature will change gradually from those of S12' (with feature characteristics similar to those of S1) to those of S12 (with feature characteristics more similar to S2 as gB decreases). By changing gB and gF differently over time, a fast transition from S1 to S2 (preserving feature information) can be obtained, in combination with, or followed by, a slower transition for the feature information.

Figure 9:
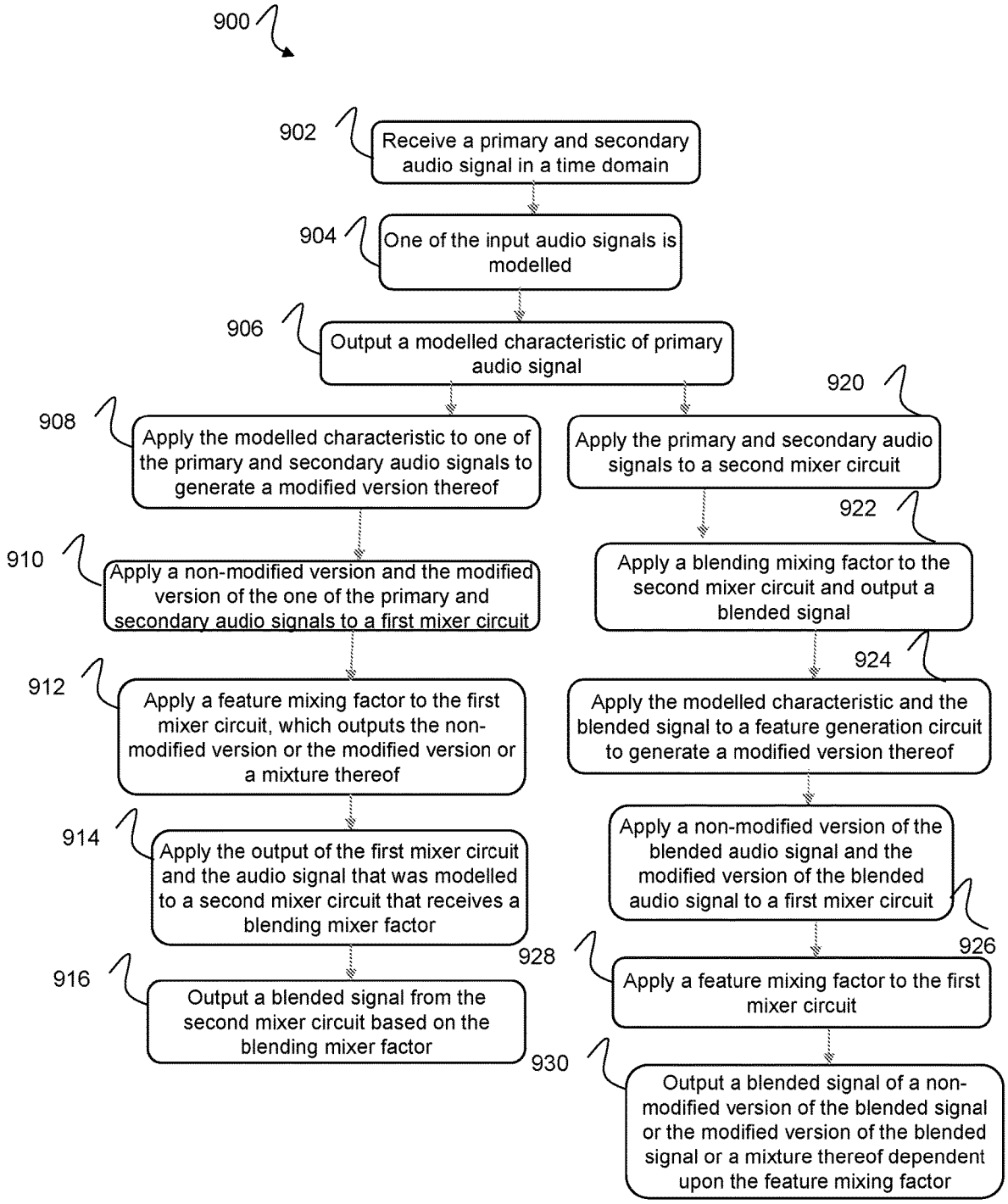
FIG. 9 illustrates an example flow chart for audio signal blending, according to example embodiments of the invention.

Referring now to FIG. 9 illustrates an example flowchart 900 for audio signal blending. At 902, a primary and a secondary receive broadcast audio signals are received. At 904, a first one of the input audio signals is modelled, for example in a feature model estimation circuit 440, 840 as shown in FIG. 4 and FIG. 8. At 906 the modelled characteristic is output.

In this example, at 908 and following the operation of FIG. 4, the modelled characteristic is applied to one of the primary and secondary audio signals to generate a modified version thereof. At 910, a non-modified version and the modified version of the one of the primary and secondary audio signals is applied to a feature mixing circuit. At 912, a feature mixing factor is applied to the feature mixing circuit, which outputs the non-modified version or the modified version or a mixture thereof. At 914, the output of the feature mixing circuit and the primary audio signal that was modelled are applied to a blending mixing circuit that also receives a blending mixer factor. At 916, a blended signal is output from the blending mixing circuit based on the blending mixer factor.

In an alternative example, at 920 and following the operation of FIG. 8, the primary and secondary audio signals are applied to a blending mixing circuit. At 922, a blending mixing factor is applied to the blending mixing circuit and a blended signal output therefrom. At 924, the modelled characteristic and the blended signal are input to a feature generation circuit to generate a modified version the blended signal. At 926, a non-modified version of the blended audio signal and the modified version of the blended audio signal are input to a feature mixing circuit. At 928, a feature mixing factor is applied to the feature mixing circuit, to modify at least one of the audio signals input thereto. At 930, a non-modified version of the blended signal or the modified version of the blended signal or a mixture thereof is output from the feature mixing circuit dependent upon the feature mixing factor.

In the foregoing specification, the invention has been described with reference to specific examples of embodiments of the invention. It will, however, be evident that various modifications and changes may be made therein without departing from the scope of the invention as set forth in the appended claims and that the claims are not limited to the specific examples described above.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the architectures depicted herein are merely exemplary, and that in fact many other architectures can be implemented which achieve the same functionality.

Any arrangement of components to achieve the same functionality is effectively 'associated' such that the desired functionality is achieved. Hence, any two components herein combined to achieve a particular functionality can be seen as 'associated with' each other such that the desired functionality is achieved, irrespective of architectures or intermediary components. Likewise, any two components so associated can also be viewed as being 'operably connected,' or 'operably coupled,' to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented on a single integrated circuit, for example in software in a digital signal processor (DSP) as part of a radio frequency integrated circuit (RFIC).

Alternatively, the circuit and/or component examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired sampling error and compensation by operating in accordance with suitable program code, such as minicomputers, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms 'a' or 'an,' as used herein, are defined as one or more than one. Also, the use of introductory phrases such as 'at least one' and 'one or more' in the claims should not be construed to imply that the introduction of another claim element by the indefinite articles 'a' or 'an' limits any particular claim containing such introduced claim element to inventions containing only one such element, even when the same claim includes the introductory phrases 'one or more' or 'at least one' and indefinite articles such as 'a' or 'an.' The same holds true for the use of definite articles. Unless stated otherwise, terms such as 'first' and 'second' are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. An audio processing circuit characterised by:

at least one input configured to receive a primary audio signal and a feature generation signal;

a feature model estimation circuit configured to model a feature in a primary audio signal and output a feature model signal of the primary audio signal; and a feature generation circuit coupled to the feature model estimation circuit and configured to receive the feature model signal and the feature generation signal and, in response to the feature model signal:

modify the feature generation signal; and output a modified representation of the feature generation signal that is more similar to the primary audio signal.

2. The audio processing circuit of claim 1, wherein the feature generation signal is a secondary audio signal.

3. The audio processing circuit of claim 1, further comprising a feature mixing circuit coupled to an output of the feature generation circuit and configured to receive a feature mixing factor and both of the feature generation signal and the modified representation of the feature generation signal.

4. The audio processing circuit of claim 3, further comprising a blending mixing circuit configured to receive a blending mixing factor and both of the primary audio signal and an output of the feature mixing circuit.

5. The audio processing circuit of claim 4, wherein the blending mixing circuit is configured to output a blended audio signal in response to the blending mixing factor that comprises one of:

(i) the primary audio signal, (ii) the output of the feature mixing circuit, (iii) a blended mixture of (i) and (ii).

6. The audio processing circuit of claim 3, wherein the blending mixing circuit is configured to provide the feature generation signal to the feature generation circuit and configured to receive a blending mixing factor and both of the primary audio signal and the secondary audio signal.

7. The audio processing circuit of claim 6, wherein an output of the blending mixing circuit comprises one of:

the primary audio signal, (ii) the secondary audio signal, (iii) a blended mixture of (i) and (ii).

8. The audio processing circuit of claim 6, wherein the feature mixing circuit is configured to receive a feature mixing factor and both of an output from the blending mixing circuit and a modified representation of the output from the blending mixing circuit in response to the feature model signal.

9. The audio processing circuit of claim 3, wherein at least one of the blending mixing factor and the feature mixing factor varies over time.

10. The audio processing circuit of claim 1, wherein the feature model estimation circuit models at least one of the following features: stereo information, high-frequency information, of the primary audio signal.

11. The audio processing circuit of claim 2, wherein the primary audio signal is received from a first broadcast audio signal and the secondary audio signal is received simultaneously from a second broadcast audio signal.

12. The audio processing circuit of claim 11, wherein the first broadcast audio signal and second broadcast audio signal comprise at least one of: amplitude modulated broadcast, frequency modulated broadcast, digital audio broadcast.

13. An audio unit that includes an audio processing circuit, the audio processing circuit comprising:

at least one input configured to receive a primary audio signal and a feature generation signal;

a feature model estimation circuit configured to model a feature in a primary audio signal and output a feature model signal of the primary audio signal; and a feature generation circuit coupled to the feature model estimation circuit and configured to receive the feature model signal and the feature generation signal and, in response to the feature model signal:

modify the feature generation signal; and output a modified representation of the feature generation signal that is more similar to the primary audio signal.

14. A method of spectrum blending in an audio unit, the method comprising:

receiving a primary audio signal and a feature generation signal;

modelling a feature in the primary audio signal;

outputting a feature model signal of the primary audio signal;

receiving the feature model signal and the feature generation signal at a feature generation circuit and, in response to the feature model signal:

modifying the feature generation signal; and outputting a modified representation of the feature generation signal that is more similar to the primary audio signal.

* * * * *